US010233553B2

(12) United States Patent
Dufresne

(10) Patent No.: US 10,233,553 B2
(45) Date of Patent: Mar. 19, 2019

(54) CONTACT BAR AND CAPPING BOARD FOR SUPPORTING SYMMETRICAL ELECTRODES FOR ENHANCED ELECTROLYTIC REFINING OF METALS

(71) Applicant: Pultrusion Technique Inc., St-Bruno (CA)

(72) Inventor: Robert Dufresne, St-Bruno (CA)

(73) Assignee: Pultrusion Technique Inc., St-Bruno (Quebec) (CA)

( * ) Notice: Subject to any disclaimer, the term of this patent is extended or adjusted under 35 U.S.C. 154(b) by 276 days.

(21) Appl. No.: 14/992,673

(22) Filed: Jan. 11, 2016

(65) Prior Publication Data

US 2016/0122887 A1 May 5, 2016

Related U.S. Application Data

(62) Division of application No. 14/232,102, filed as application No. PCT/CA2010/050480 on Jul. 12, 2012, now Pat. No. 9,234,287.

(Continued)

(51) Int. Cl.
*C25C 7/00* (2006.01)
*C25D 17/00* (2006.01)

(Continued)

(52) U.S. Cl.
CPC ..... *C25C 7/00* (2013.01); *C25B 9/04* (2013.01); *C25C 7/02* (2013.01); *C25D 17/007* (2013.01); *Y10T 29/49117* (2015.01)

(58) Field of Classification Search
CPC .... C25D 17/007; C25D 17/00; C25D 17/005; C25C 7/00; C25C 7/02; C25C 7/06; C25B 9/00; C25B 9/04

(Continued)

(56) References Cited

U.S. PATENT DOCUMENTS 4,479,863 A * 10/1984 Honey ..... C25C 7/02 204/267
6,342,136 B1 1/2002 Virtanen et al.

(Continued)

FOREIGN PATENT DOCUMENTS

CA 1034533 7/1978
CA 1201681 3/1986

OTHER PUBLICATIONS

Search Report dated Sep. 14, 2012 from International Patent Application No. PCT/CA2012/050480.

*Primary Examiner* — Alexander W Keeling
(74) *Attorney, Agent, or Firm* — Baker & Hostetler LLP

(57) ABSTRACT

A contact bar and related techniques allow enhanced electrolytic refining of metals, e.g. avoiding or reducing electrical short circuits. The contact bar is adapted to rest on an insulating capping board for contacting symmetrical electrodes to provide locations for electrical contact therewith. The contact bar includes a central portion laying on the capping board and branch portions extending laterally outward from the central portion, such that the branch portions fit in between seats of the capping board. The contact bar may include a retention member enabling to reduce lateral movement of the electrodes, and may include a plurality of apertures to engage corresponding holding arms of the capping board. There may be a plurality of adjacent similar contact bar segments.

11 Claims, 22 Drawing Sheets

Related U.S. Application Data

(60) Provisional application No. 61/506,701, filed on Jul. 12, 2011, provisional application No. 61/578,944, filed on Dec. 22, 2011, provisional application No. 61/617,379, filed on Mar. 29, 2012.

(51) Int. Cl.
*C25B 9/04* (2006.01)
*C25C 7/02* (2006.01)

(58) Field of Classification Search
USPC ..... 204/279
See application file for complete search history.

(56) References Cited

U.S. PATENT DOCUMENTS

| | | | | |
|---|---|---|---|---|
| 9,234,287 | B2 * | 1/2016 | Dufresne | C25C 7/00 |
| 2005/0121319 | A1 * | 6/2005 | Dufresne | C25C 7/02<br>204/297.1 |
| 2005/0284753 | A1 * | 12/2005 | Dufresne | C25C 7/00<br>204/288 |
| 2015/0354075 | A1 * | 12/2015 | Dufresne | C25C 7/02<br>204/297.01 |

* cited by examiner

CONTACT BAR AND CAPPING BOARD FOR SUPPORTING SYMMETRICAL ELECTRODES FOR ENHANCED ELECTROLYTIC REFINING OF METALS

REFERENCE TO RELATED APPLICATIONS

This application is a divisional of U.S. patent application Ser. No. 14/232,102 filed Jan. 10, 2014 now U.S. Pat. No. 9,234,287 issued Jan. 12, 2016, which is a National Stage of International Application No. PCT/CA2012/050480, filed on Jul. 12, 2012, which claims priority to U.S. Provisional Application Nos. 61/506,701, filed on Jul. 12, 2011; 61/578,944, filed Dec. 22, 2011; and 61/617,379, filed Mar. 29, 2012, the disclosures of which are incorporated by reference in their entirety.

FIELD OF THE INVENTION

The present invention generally pertains to an enhanced contact bar and capping board and related techniques for electrolytic refining of metals.

BACKGROUND OF THE INVENTION

In the hydrometallurgical industry, it is of common practice to refine metal by electrolysis in electrolytic cells especially designed for this purpose. The metals to be refined are usually conventional metals such as copper, zinc, nickel or cadmium, or precious metals such as silver, platinum or gold, and others.

It is also of common practice to use metal plates as anodes or cathodes or both. These metal plates often weight several hundred pounds. Usually, the metal to be refined, or the metal used to carry the electric current, is in the form of plates of a given thickness, which are provided at their upper end with two laterally extending projections, called hanging legs. Such projections facilitate gripping, handling and hanging of the plates on lateral sidewalls of the cells. These projections also serve to electrically contact or insulate the electrode.

In use, the electrode plates which, as mentioned, can each weigh several hundred pounds, are immersed into the cells in parallel relationship and are used as anodes, cathodes or both, depending on the affinity of the metal being refined.

In order to have the electrodes positioned in a precise desired location, it is of common practice to place a component called a "capping board" or a "bus bar insulator" onto the top surface of each lateral sidewall of the cells. These capping boards are used to position the plates with respect to each other. They are also used as electric insulators between adjacent cells and/or the electrodes and/or the ground.

In practice, the capping boards are used not only as supports to position the electrodes, but also as supports to avoid damage to the masonry, concrete or polymer-concrete forming the lateral side walls of the cells during the insertion and removal of the heaving electrodes. They are also used for electrolytic refining and electrowinning of metals.

Insulating capping boards are used to hold the electrodes at very precise positions. They are also used in combination with electrically conductive "contact bars" the purpose of which is to allow electrical connection between the ends of the anodes and cathodes located in adjacent cells. Thus, the combined use of capping boards and contact bars allows both insulation and distribution of electric current.

To achieve proper electrical contact with the contact bar, the plates forming the electrodes are provided with support hanging legs externally projecting on their opposite upper ends. Only one end of the legs of each plate is in contact with a contact bar on one side of the cell where it is located. The other leg of the same plate is held onto the capping board located on the opposite side of the cell in such a way as to be insulated. Thus, the capping board per se plays the role of an insulator and is thus made of insulating material. The contact bar usually extends over the full length of the corresponding capping board in order to connect altogether all the anodes of one cell to all the cathodes of the adjacent cell and vice versa. The contact bar may interconnect all of the cathodes to the anodes on other adjacent cells or perform other electric connection function between electrodes as desired.

In hydrometallurgical refining of metals, there are two main configurations that may be used to support the electrodes: symmetrical configurations using symmetrical anodes and cathodes and asymmetrical configurations using asymmetrical anodes and cathodes. The capping boards and contact bars are provided depending on the type of electrodes to be used. Thus, different capping board and contact bar systems will be used for symmetrical and asymmetrical electrodes.

The electrolytic system using symmetrical electrodes uses an assembly of three different components. Referring to FIG. 1 (Prior Art), there is a first insulator 10 referred to as a "bus bar insulator", a machined dog bone contact bar 12 and a second insulator 14 referred to as a "coronary insulator". FIG. 2 (Prior Art) shows a perspective view of part of the machined dog bone contact bar 12. Symmetrical support systems are practical and require low level of monitoring since for the electric positioning either side of the electrodes can be used and interchanged because the hanging bars are symmetrical. However, it is inconvenient and expensive to require two insulators 10 and 14 as well as a contact bar that is rather large and thus expensive. In addition, in such known symmetrical systems, copper (or other metals) sulphate and acid mist called "sulphatation" may occur between the two insulators, which corrodes the contact bar and allows passage of electric current. Such current leakage creates significant efficiency losses and the acid mist sulphatation also results in a lower quality of refined metal such as copper and reduced overall efficiency of the refining process.

Another disadvantage is that when the contact bar or coronary insulator breaks or become unusable, replacement is very complicated, difficult and time consuming. The electrolytic system using asymmetrical electrodes uses an assembly of two different components. Referring to FIG. 3 (Prior Art), there is a contact bar 16 laying on a insulating capping board 18 having two rows of alternating staggered or "offset" insulating seats 20 in between which the contact bar 16 sits. Asymmetrical support systems require a great deal of monitoring since inverse positioning of the anodes or cathodes can cause significant problems and damage. Monitoring is thus a significant expense. Errors in installation inadvertently inversing the orientation of the electrodes is problematic and dangerous because it can cause, for example, major short circuits requiring production downtime, and can create or induce fire, making their use more onerous and dangerous.

In addition, by way of further background in the field of capping boards and/or contact bars, the following patent documents U.S. Pat. No. 5,645,701, U.S. Pat. No. 7,204,919, U.S. Ser. No. 12/528,435, U.S. Pat. No. 7,223,324 and U.S. Ser. No. 12/524,852, are hereby incorporated herein by reference.

There is indeed a need in the industry for a technology that would overcome at least some of the aforementioned disadvantages and challenges.

SUMMARY OF THE INVENTION

The invention provides a contact bar, a contact bar segment, a capping board, a contact bar and capping board assembly, an electrolytic apparatus, a method and use for enhanced electrolytic refining. In some aspects, the contact bar and related techniques enable avoiding or reducing electrical short circuits.

In one aspect of the present invention, there is provided a contact bar for use in an electrolytic cell for resting on an insulating capping board and for contacting symmetrical electrodes to provide electrical contact therewith. The contact bar can rest on the insulating capping board, providing locations for electrical contact for symmetrical electrodes.

The contact bar includes a central portion laying on the capping board and branch portions extending laterally outward from the central portion. The branch portions include two sets of branch portions configured on either side of the central portion and each set is in staggered or offset relation to the opposed set, such that the branch portions fit in between seats of the capping board. Each branch portion is spaced, sized and configured and has an electrode bearing member so as to provide support and electrical contact with one of the symmetrical electrodes.

In another aspect of the present invention, there is provided a contact bar segment for use in an electrolytic cell for resting on an insulating capping board and contacting symmetrical electrodes to provide electrical contact therewith. The contact bar segment includes a central portion laying on a section of the capping board and branch portions extending laterally outward from the central portion. The branch portions include two sets of branch portions configured on either side of the central portion and each set is in staggered or offset relation to the opposed set, such that the branch portions fit in between seats of the capping board. Each branch portion is spaced, sized and configured and has an electrode bearing member so as to provide support and electrical contact with one of the symmetrical electrodes.

In an optional aspect of the contact bar or contact bar segment, the contact bar or contact bar segment may include lateral recesses between the branch portions which are sized and arranged such that the branch portions fit in between the seats of the capping board. The lateral recesses may be U-shaped recesses or V-shaped recesses.

In another optional aspect of the contact bar or contact bar segment, each branch portion may include a bearing member projecting upwardly from the branch portion. Optionally, each bearing member may have a generally triangular cross-section.

In another optional aspect of the contact bar or contact bar segment, each bearing member of one opposed set of branch portions may have an upper pointed end and each bearing member of the other opposed set of branch portions may have an upper rounded end. Alternatively, each bearing member may have an upper pointed end.

In another optional aspect of the contact bar or contact bar segment, each bearing member may have a height in conjunction with the seats of the capping board for holding hanging bars of the electrodes in a straight and horizontal manner.

In another optional aspect of the contact bar or contact bar segment, the contact bar or contact bar segment may include at least one retention member having a body extending longitudinally along the central portion and extending upwardly from the central portion. The retention member enables to reduce or prevent lateral movement of the electrodes.

In another optional aspect of the contact bar or contact bar segment, a size of the at least one retention member may be proportional to a size of the corresponding bearing member.

In another optional aspect of the contact bar or contact bar segment, the at least one retention member may have a distal end and an upper portion which is tapered toward the distal end. Optionally, the distal end of the at least one retention member may be higher than ends of the bearing members.

In another optional aspect of the contact bar or contact bar segment, the at least one retention member may include a main rod which has a square cross-section. Optionally, the at least one retention member may include a main rod which has a circular cross-section.

In another optional aspect of the contact bar or contact bar segment, the at least one retention member may have a proximal end which is an attachment peg cooperating with the corresponding branch portion of the contact bar or contact bar segment.

In another optional aspect of the contact bar or contact bar segment, the at least one retention member may be molded with the contact bar or contact bar segment as a one-piece structure. Optionally, the at least one retention member may be screwed, glued or nested into the corresponding branch portion of the contact bar or contact bar segment.

In another optional aspect of the contact bar or contact bar segment, the at least one retention member may include a plurality of similar retention members organized in two sets of retention member rows arranged in a staggered relationship with one another. Each retention member may be in spaced relationship with the corresponding bearing member on the same branch portion.

In another optional aspect of the contact bar or contact bar segment, the central portion may include a plurality of holes positioned along the central channel and organized in two sets of hole rows arranged in a staggered relationship with one another, so as to offer an attachment location to each retention member at a proximal part of each branch portion.

In another optional aspect of the contact bar or contact bar segment, the contact bar or contact bar segment may include a plurality of apertures organized in two sets of rows arranged in a staggered relationship with one another along the central portion. The apertures may be sized and shaped to engage corresponding holding arms of the capping board.

In another optional aspect of the contact bar or contact bar segment, the apertures may have an internal surface comprising a lower portion which is tapered toward a bottom surface of the contact bar or contact bar segment so as to form a tapered surface. Optionally, the tapered surface of the each aperture may be inclined at a 45° angle respectively to the bottom surface of the contact bar or contact bar segment.

In another optional aspect of the contact bar or contact bar segment, the contact bar or contact bar segment may be manufactured by a first step of extrusion or casting, following by a second step of machining.

In another aspect of the present invention, there is provided a capping board for use in an electrolytic cell with a contact bar or contact bar segment and symmetrical electrodes. The capping board includes a main elongated body. The capping board further includes two rows of seats extending upward from the main elongated body. The seats provide support and electric insulation for the symmetrical electrodes. Each of the two rows of seats are arranged in staggered or offset relationship with respect to the opposed row of seats so as to define a central elongated channel and adjacent seats of each row are spaced apart to define a lateral channel. The central elongated channel and the lateral channel are sized and shaped for receiving the contact bar or the contact bar segment such that the latter provides support and electrical contact with hanging bars of the electrodes. Optionally, the central elongated channel may be centered on the capping board.

In an optional aspect of the capping board, the capping board may include a plurality of holding arms organized in two sets of arm rows arranged in a staggered relationship with one another along the central elongated channel. The holding arms may also be in spaced relationship with the corresponding row of seats of the capping board and each holding arm may project upwardly from the central elongated channel of the capping board. Optionally, each holding arm may have an upper portion which is tapered toward a distal end of the holding arm, so as to form a tapered surface. Optionally, each holding arm may include at least one reinforcing rod which is sized and shaped to be embedded therein.

In another aspect of the present invention, there is provided a contact bar and capping board assembly for use in an electrolytic cell with symmetrical electrodes. The assembly includes a contact bar as defined above and a capping board as defined above.

In another aspect of the present invention, there is provided a contact bar and capping board assembly for use in an electrolytic cell with symmetrical electrodes. The assembly includes a plurality of contact bar segments as defined above and a capping board as defined above. The contact bar segments are positioned adjacent to one another so as to form a contact bar adapted to the capping board.

In another aspect of the present invention, there is provided a contact bar and capping board assembly for use in an electrolytic cell with symmetrical electrodes. The assembly includes a capping board and a contact bar. The capping board includes a main elongated body and two rows of seats extending upward from the main elongated body. The seats provide support and electric insulation for the symmetrical electrodes. The two rows of seats are arranged in staggered or offset relationship with respect to the opposed row of seats so as to define a central elongated channel. Adjacent seats of each row are spaced apart to define a lateral channel.

The capping board also includes two rows of holding arms arranged in a staggered relationship with one another along the central elongated channel. Each holding arm is in spaced relationship with the corresponding seat on the lateral channel. The contact bar includes a central portion laying on the central elongated channel of the capping board. The contact bar further includes branch portions extending laterally outward from the central portion. The branch portions are arranged in two sets of branch portions configured on either side of the central portion. Each of these two sets is in staggered or offset relationship to the opposed set, such that the branch portions fit in between seats of the capping board. Each branch portion is spaced, sized and configured and has an electrode bearing member so as to provide support and electrical contact with hanging bars of one of the electrodes. The contact bar also includes two rows of apertures arranged in opposed and staggered relationship with one another along the central portion. Each aperture is in spaced relationship with the corresponding electrode bearing member on the branch portion, so as to receive the corresponding holding arms of the capping board.

In another aspect of the present invention, there is provided an electrolytic apparatus for refining metal. The apparatus includes an electrolytic cell, a plurality of symmetrical electrodes, a capping board and a contact bar. The plurality of symmetrical electrodes includes plates extending within the electrolytic cell and hanging bars extending laterally out of the electrolytic cell. The capping board is supported on lateral side walls of the electrolytic cell and includes two rows of offset seats. The seats are provided to support some of the hanging bars of the symmetrical electrodes and insulate the same. The contact bar includes two opposed and offset sets of branch portions configured to fit respectively in between the rows of offset seats of the capping board. The branch portions have bearing members for supporting some of the symmetrical electrodes for electrical contact therewith.

In another aspect, there is provided a contact bar or contact bar segment for use in an electrolytic cell for resting on an insulating capping board and contacting electrodes to provide electrical contact therewith, the contact bar or contact bar segment comprising:

a central portion laying on the capping board; and branch portions extending laterally outward from the central portion, the branch portions comprising two sets of branch portions configured on either side of the central portion and each set being in staggered or offset relation to the opposed set, such that the branch portions fit in between seats of the capping board, each branch portion being spaced, sized and configured and having an electrode bearing member so as to provide support and electrical contact with one of the electrodes.

In another aspect; there is provided a method of supporting and electrically contacting symmetrical electrodes in an electrolytic apparatus for refining metal, the method comprising:

providing a contact bar or contact bar segment having one or more aspects as defined above or herein;

providing a capping board having one or more aspects as defined above or herein; and placing electrodes, such as symmetrical electrodes, in electrical contact with corresponding electrode bearing members of the contact bar or contact bar segment.

In another aspect, there is provided a use of a contact bar or contact bar segment having one or more aspects as defined above or herein, for supporting and providing electrical contact with electrodes, such as symmetrical electrodes.

While the invention will be described in conjunction with example embodiments, it will be understood that it is not intended to limit the scope of the invention to such embodiments. On the contrary, it is intended to cover all alternatives, modifications and equivalents as may be included as defined by the present description. The objects, advantages and other features of the present invention will become more apparent and be better understood upon reading of the following non-restrictive description of the invention, given with reference to the accompanying drawings.

It should be understood that any one of the above mentioned optional aspects of each contact bar, contact bar segment, capping board, contact bar and capping board assembly and electrolytic apparatus may be combined with any other of the aspects thereof, unless two aspects clearly cannot be combined due to their mutually exclusivity. For example, the various structural elements of the contact bar or contact bar segment described herein-above, herein-below and/or in the appended Figures, may be combined with any of the capping board, contact bar and capping board assembly or electrolytic apparatus descriptions appearing herein and/or in accordance with the appended claims.

DETAILED DESCRIPTION

Figure 18:
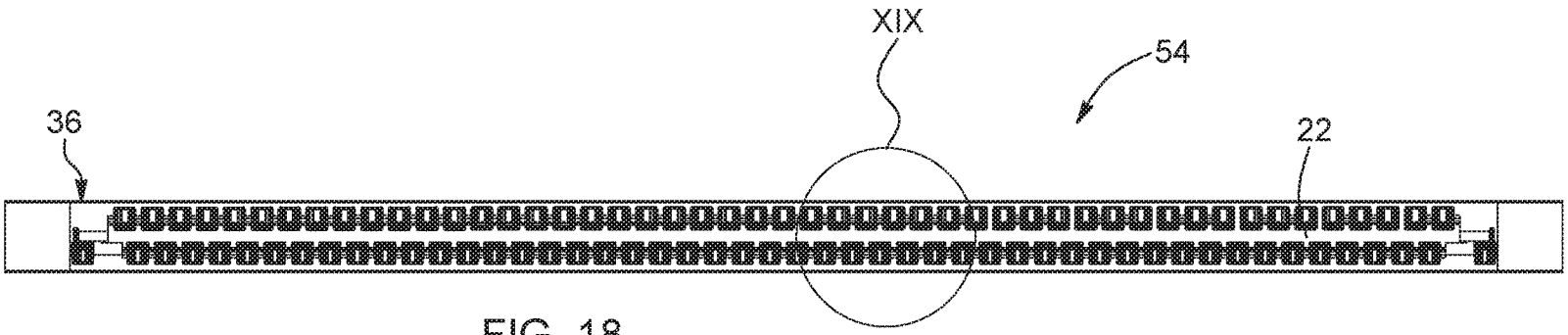
FIG. 18 is a top plan view of a capping board and contact bar assembly according to another embodiment of the present invention.
Figure 19:
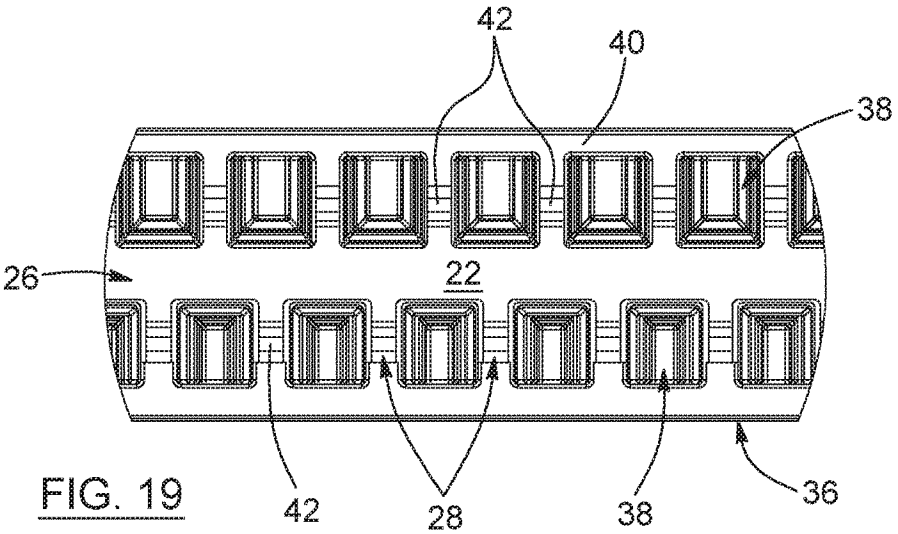
FIG. 19 is a close-up view of area XIX of FIG. 18.

FIGS. 7-47 illustrate embodiments of a contact bar, a capping board and apparatus for electrolytic refining of metals. In particular, FIGS. 8 and 18-19 illustrate embodiments of the present invention including a contact bar 22. FIGS. 7, 9-17, 20-25, 30-31, 34-36 and 41-44 illustrate an embodiment of the present invention including a contact bar segment 24 used to form a contact bar.

In the case of both the segmented contact bar formed of segments 24 and the integral one-piece contact bar 22, many features are the same and will be described below referring to only one of these two embodiments.

Figure 7:
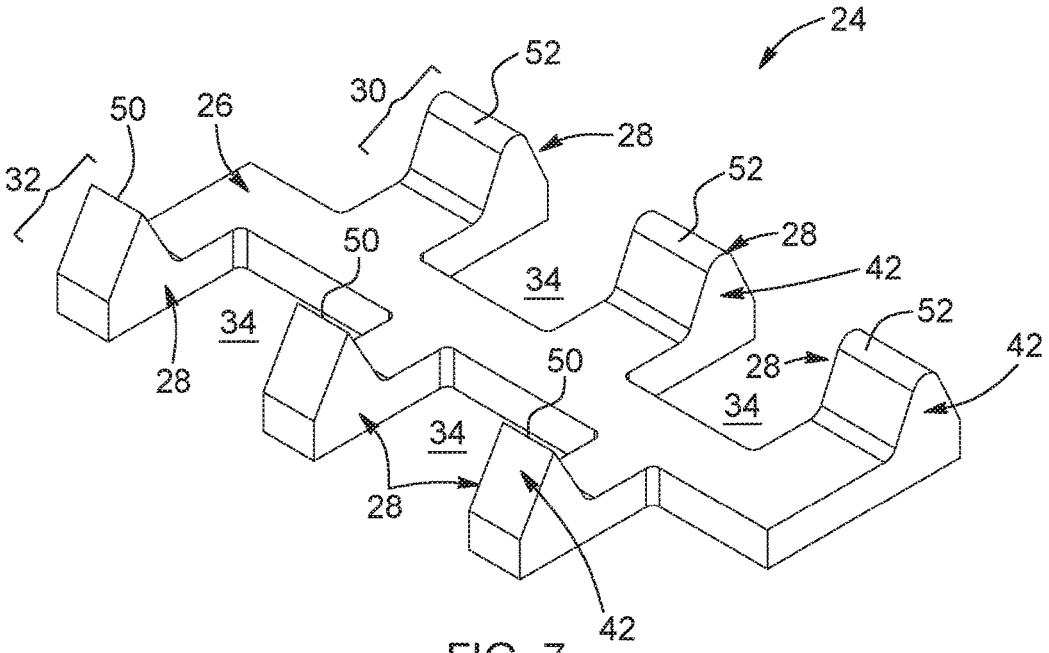
FIG. 7 is a top perspective view of a contact bar segment according to an embodiment of the present invention.
Figure 8:
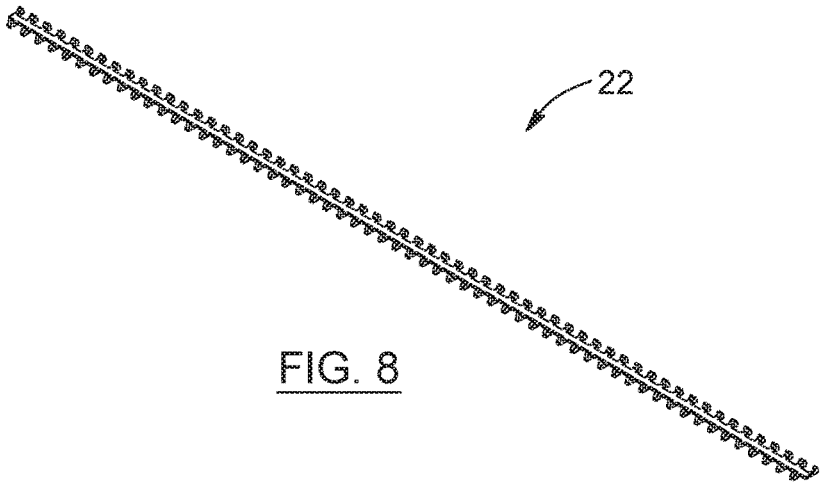
FIG. 8 is a top perspective view of a contact bar according to another embodiment of the present invention.
Figure 13:
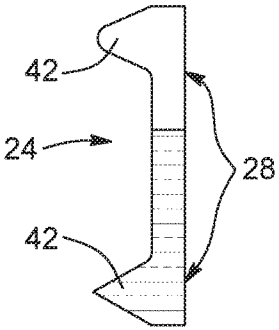
FIG. 13 is a side cross-sectional view along line XIII of FIG. 9.
Figure 10:
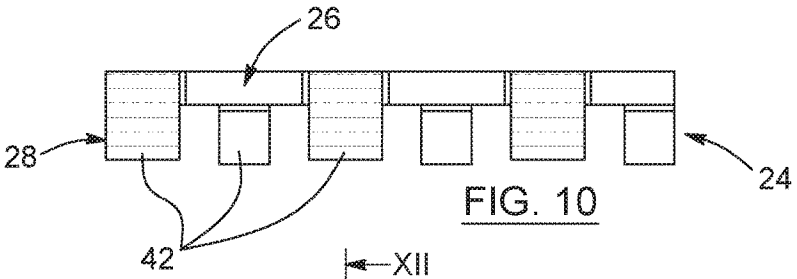
FIG. 10 is a side cross-sectional view along line X of FIG. 9.

Referring to FIG. 7, the contact bar or segment includes a central portion 26 and a plurality of branch portions 28. The branch portions 28 extend laterally outward from the central portion 26 and include two sets 30, 32 of branch portions configured on either side of the central portion 26. FIG. 7 shows each set 30, 32 having three branch portions 28 on a single contact bar segment 24, but it should be understood that the segments or contact bar may include any number of desired branch portions 28 on each side. Preferably, each set 30, 32 is in staggered or offset relation to the opposed set 32, 30. As illustrated in FIG. 7, adjacent branched portions 28 of each set 30, 32 may be separated by a lateral recess 34. The contact bar or contact bar segment may have in plan view a shape having opposed and offset corrugations, such corrugations defining the branch portions as described herein.

Figure 15:
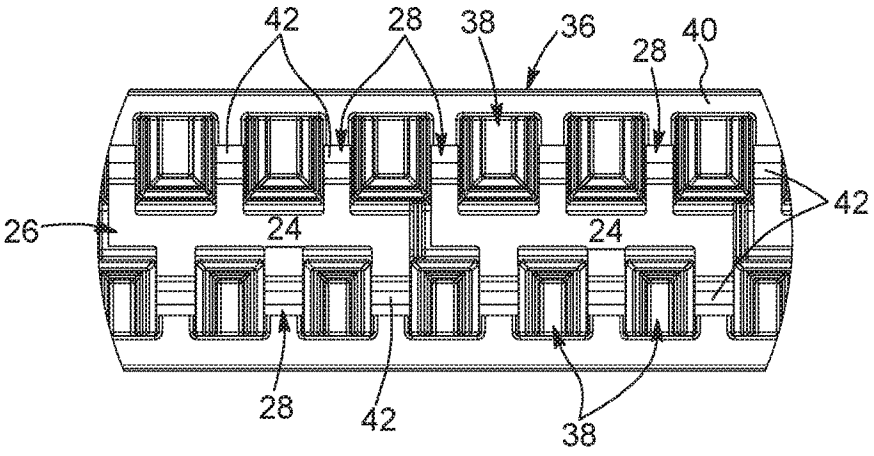
FIG. 15 is a close-up view of area XV of FIG. 14.

Referring to FIGS. 15 and 19, there is a capping board 36 for use with segmented contact bar or one-piece contact bar, as the case may be. The capping board 36 has two rows of seats 38 arranged in opposed and staggered/offset relation to each other along a main elongated body 40 of the capping board 36. The branch portions 28 and the lateral recesses of the contact bar 22 (or contact bar segment 24) are thus sized and arranged such that the branch portions 28 fit in between seats 38 of the capping board 36. Each branch portion 28 is spaced, sized and configured and has an electrode bearing member 42 so as to provide support and electrical contact with one of the symmetrical electrodes (not illustrated in FIGS. 15 and 19).

Figure 16:
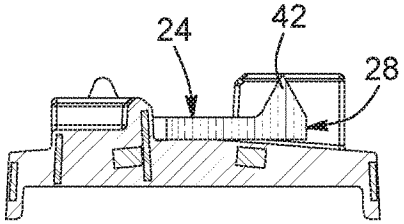
FIG. 16 is a side cross-sectional view along line XVI of FIG. 14.
Figure 17:
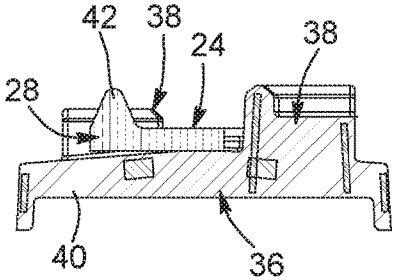
FIG. 17 is a side cross-sectional view along line XVII of FIG. 14.

Referring to FIGS. 15-17, the seats 38 extend upward from the main elongated body 40 of the capping board 36. Each of the seats 38 provides support for a corresponding one of the symmetrical electrodes by allowing the end of the hanger bar to sit in a depression defined in its upper surface. Each of the two rows of seats 38 is arranged in staggered or offset relationship with respect to the opposed row of seats so as to define a central elongated channel and adjacent seats 38 of each row being spaced apart to define a lateral channel. Thus, the central portion 26 is laid down and supported by the central elongated channel of the capping board 36 while the branch portions 28 extend are sized and configured to fit into the lateral channels of the capping board 36.

Referring to FIG. 7, the bearing member 42 of each branch portion 28 of the contact bar segment 24 is located in laterally spaced relation with respect to the central portion 26 and thus away from the central elongated channel of the capping board (not illustrated here). The bearing members 42 are located at specific distances with respect to the central portion 26 and the central elongated channel of the capping board sufficient to support the symmetrical electrodes on either side of the contact bar 22 (or contact bar segment 24). In one preferred aspect, the bearing members 42 take the form of upward projections and may have a generally triangular cross-section as illustrated. It should be noted that the bearing members 42 may have other shapes, sizes and orientations for supporting the electrodes. In another optional aspect, the bearing members 42 of one set 32 of branch portions 28 have an upper pointed end 50 while the bearing members 42 of the other set 30 of branch portions 28 have an upper rounded end 52. The pointed ends 50 are designed for supporting and contacting the anode hanger bars, since the anodes are replaced infrequently (only a few times, e.g. twice, per year), while the rounded ends 52 are designed for supporting and contacting the cathode hanger bars, since the cathodes are replaced about every fourteen days. It should be noted nonetheless that the bearing members 42 of the two opposed sets 30, 32 of branch portions 28 may sized, shaped and configured to be different or the same.

Figure 20:
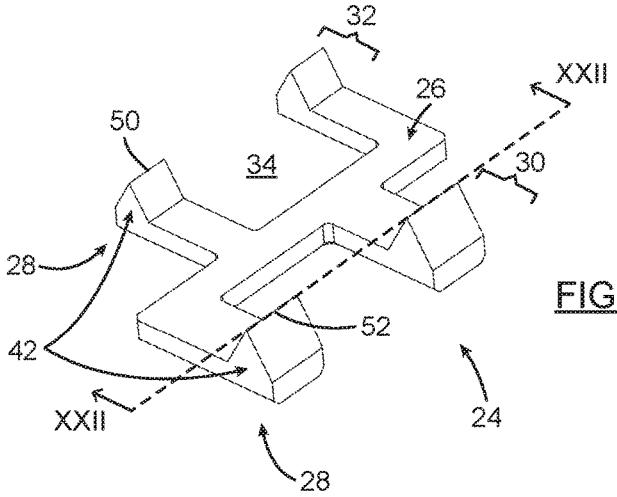
FIG. 20 is a top perspective view of a contact bar segment according to another embodiment of the present invention.
Figure 21:
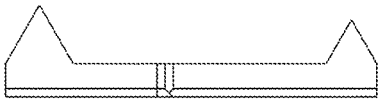
FIG. 21 is a view from behind of the contact bar segment of FIG. 20.
Figure 22:
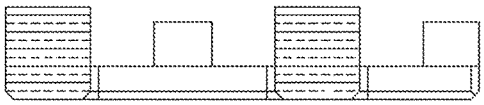
FIG. 22 is a side cross-sectional view along line XXII of FIG. 20.

In another optional aspect, the set 30 of branch portions 28 may have an upper pointed end 50 as the set 32 of branch portions 28, as better shown on FIGS. 20 and 21.

More particularly regarding the capping board, it may have a central elongated channel that is centered on the capping board or may alternatively be offset. Accordingly, the contact bar or contact bar segments are thus constructed to have an appropriate size and configuration so as to provide the bearing members at a location on the given capping board sufficient for supporting symmetrical electrodes. Thus, the particular construction, configuration and sizes of the branch portions and bearing members may be adapted for different capping boards. In this regard, FIGS. 14-19 illustrate capping boards 36 that have a central elongated channel along which the central portion 26 of the contact bar lays.

In a preferred aspect, the central portion 26 and the branch portions 28 share a common bottom surface which lays flat on the upper surface of the channels between the seats of the capping board. In another preferred aspect, the central portion 26 and proximal parts of the branch portions 28 are relatively flat shaped and shorter than the bearing members 42. This can help reduce the amount of material used for the central portion 26 and part of the branch portions 28.

Figure 1:
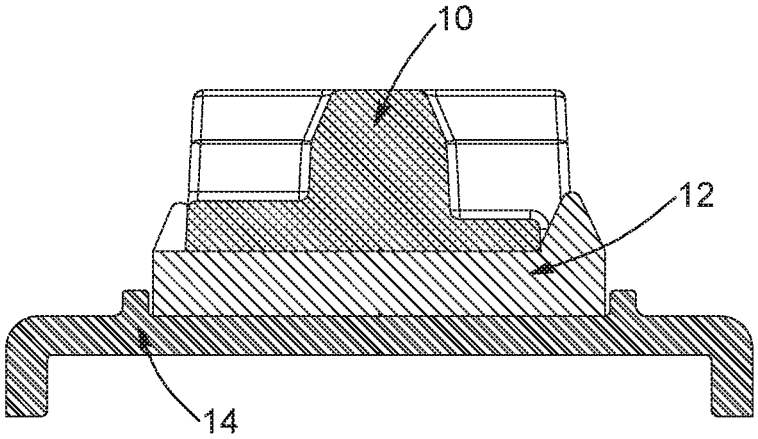
FIG. 1 (PRIOR ART)
FIG. 1 (Prior Art) is a transverse cut cross-sectional view of a known symmetrical system including two insulators and one dog bone contact bar.
Figure 2:
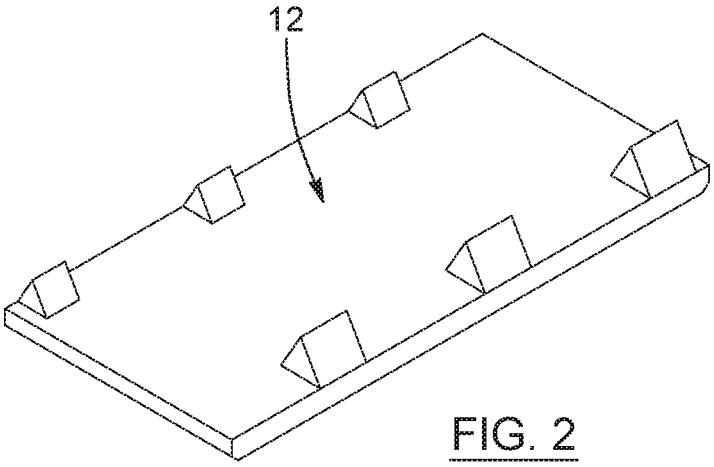
FIG. 2 (PRIOR ART)
FIG. 2 (Prior Art) is a perspective view of a dog bone contact bar.
Figure 3:
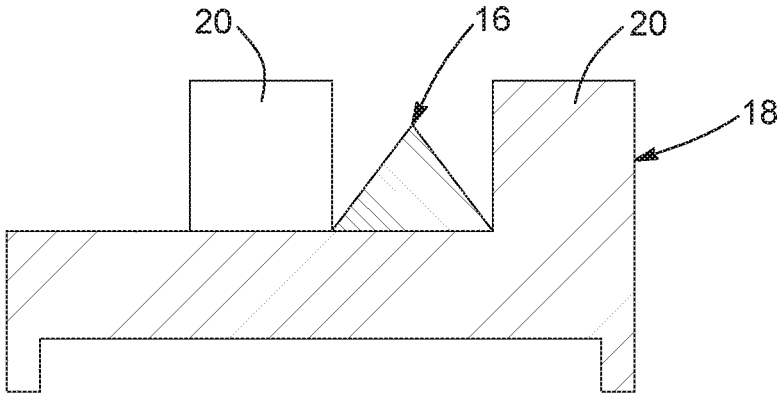
FIG. 3 (PRIOR ART)
FIG. 3 (Prior Art) is a transverse cut cross-sectional view of a known asymmetrical system including one insulators and one triangular contact bar.
Figure 4A:
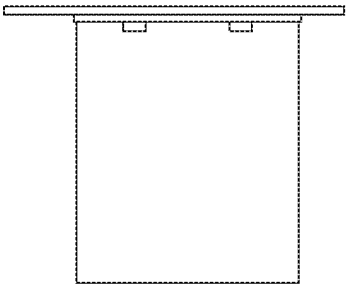
FIGS. 4*a* and 4*b* are plan views of asymmetrical electrodes.
Figure 4B:
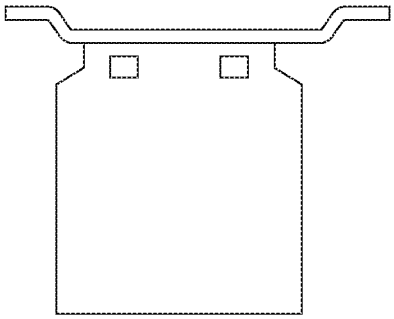
Figure 5:
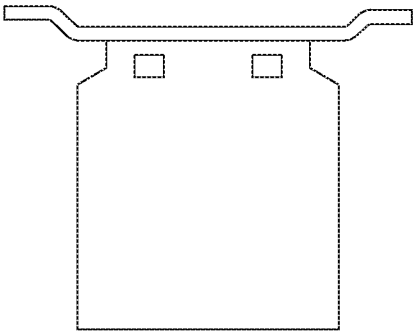
FIGS. 5 and 6 are plan views of symmetrical electrodes.
Figure 6:
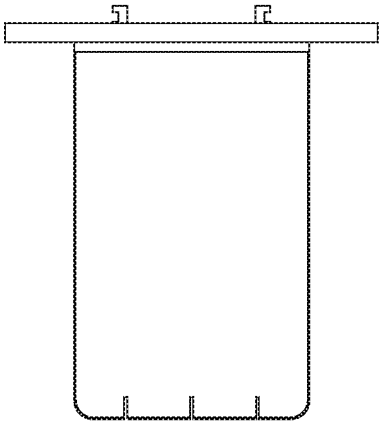

FIGS. 4*a*, 4*b*, 5 and 6 illustrate different electrodes. FIGS. 5 and 6 illustrate symmetrical electrodes that may be used in connection with the present invention.

Figure 9:
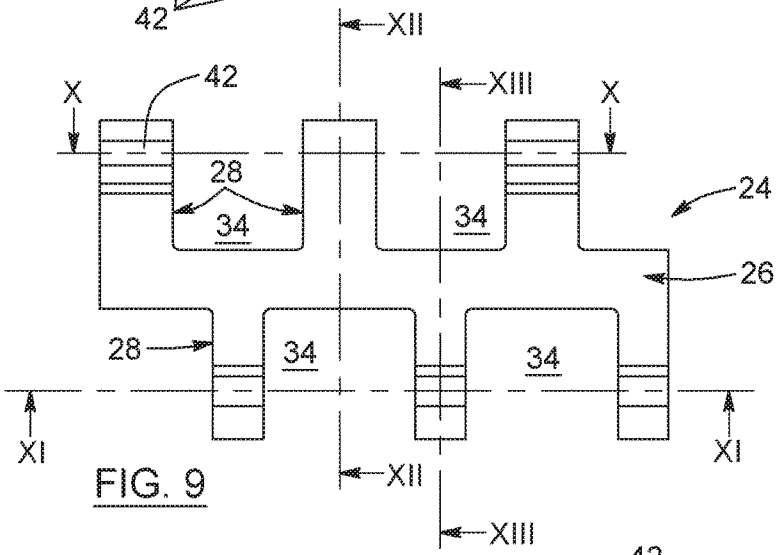
FIG. 9 is a top plan view of a contact bar section according to an embodiment of the present invention.
Figure 11:
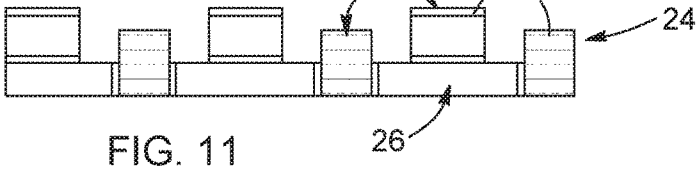
FIG. 11 is a side cross-sectional view along line XI of FIG. 9.
Figure 12:
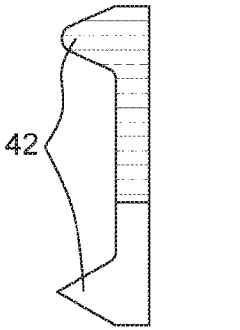
FIG. 12 is a side cross-sectional view along line XII of FIG. 9.

Referring now to FIGS. 7 and 9, the recesses 34 are preferably machined. More particularly, the contact bar or contact bar segment may be manufactured by a step of extrusion or casting, following by a second step of machining.

Referring to FIG. 10-13, the bearing members 42 are preferably provides to have certain heights and the central portion 26 is provided to have a certain thickness. For instance, the height of the bearing members 42 may be provided in conjunction with corresponding insulating seats supporting the electrodes such that the electrodes are held in a straight and horizontal manner rather than at an angle. The thickness of the central portion 26 is provided to handle the amperage of the given electrolytic cell.

In another optional aspect, the contact bar or contact bar segments fit in a generally flush manner in between the seats of the capping board. The contact bar or contact bar segment may be configured to have little to no play in between it and the components of the capping board such as the insulating seats.

Figure 14:
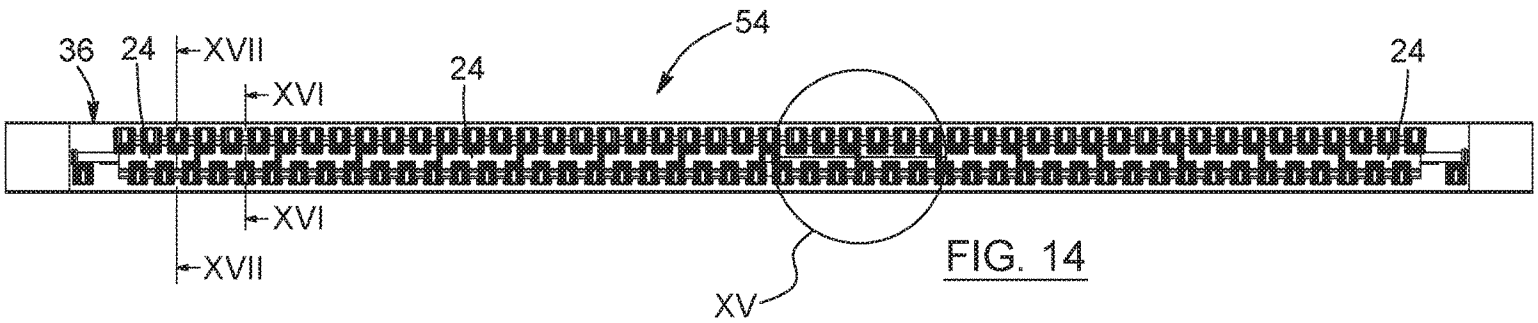
FIG. 14 is a top plan view of a capping board and contact bar assembly according to an embodiment of the present invention.

Referring to FIGS. 14 and 18, the invention may provide a contact bar and capping board assembly 54.

In another optional aspect, the contact bar or contact bar segments may have a central portion configured and shaped so as to provide recesses with various geometries.

Referring to FIG. 20, the central portion 26 may be configured and shaped so as to provide U-shaped recesses 34.

Figure 23:
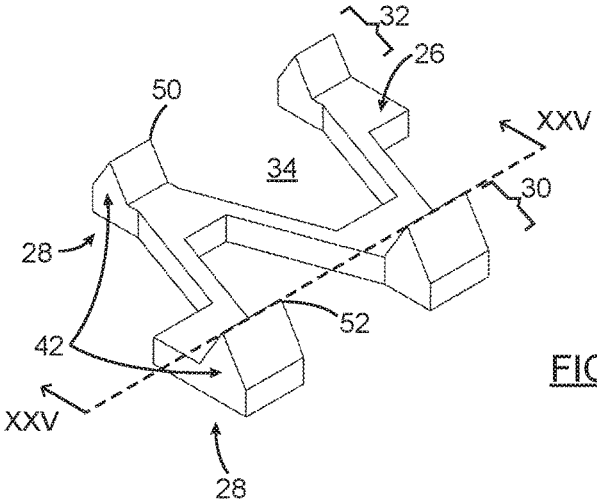
FIG. 23 is a top perspective view of a contact bar segment according to another embodiment of the present invention.
Figure 24:
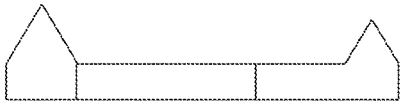
FIG. 24 is a view from behind of the contact bar segment of FIG. 23.
Figure 25:
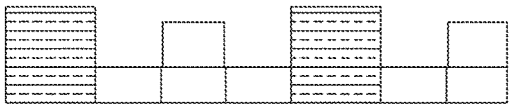
FIG. 25 is a side cross-sectional view along line XXV of FIG. 23.
Figure 26:
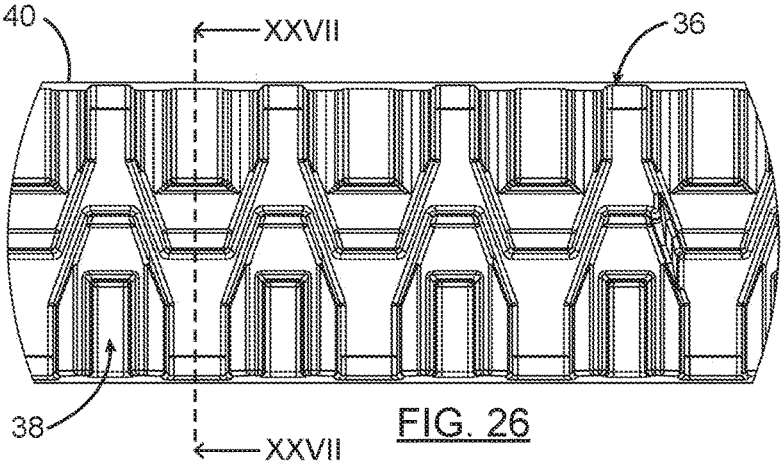
FIG. 26 is a top plan view of a portion of a capping board according to another embodiment of the present invention.
Figure 27:
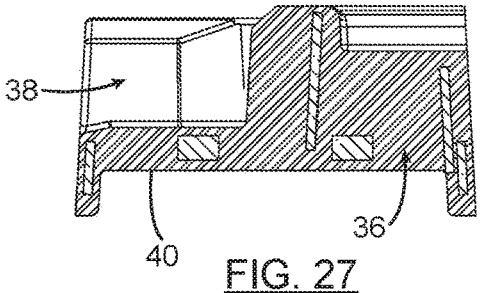
FIG. 27 is a side cross-sectional view along line XXVII of FIG. 26.
Figure 28:
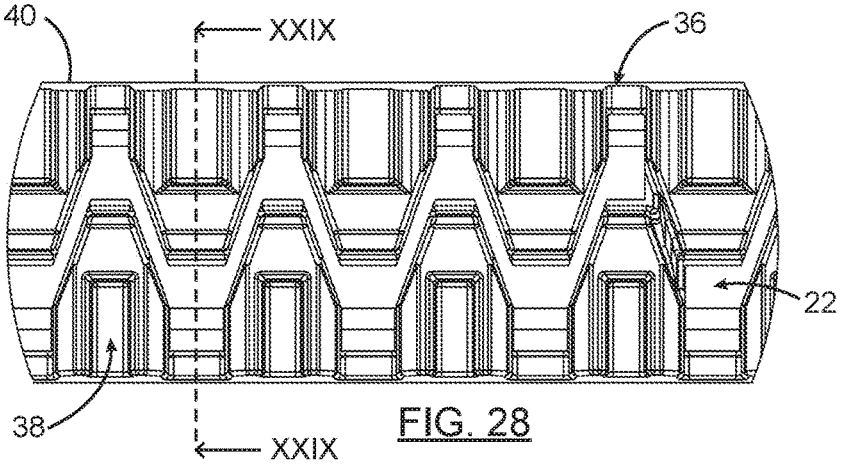
FIG. 28 is a top plan view of a portion of a capping board and contact bar assembly according to another embodiment of the present invention.
Figure 29:
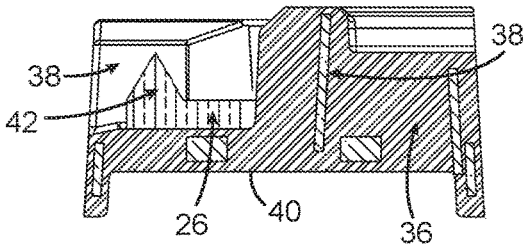
FIG. 29 is a side cross-sectional view along line XXIX of FIG. 28.

Referring to FIG. 23, the central portion 26 may be configured and shaped so as to provide V-shaped recesses 34. The central portion 26 therefore has a serpentine shape, the V-shaped recesses 34 imparting corresponding curvatures.

Referring to FIGS. 26 to 29, the capping board 36 may be configured to provide two staggered rows of V-shaped seats 38. The capping board 36 includes a corresponding central elongated channel winding between the staggered V-shaped seats 38 and along the main elongated body 40. The capping board and contact bar assembly is formed by laying the central portion 26 of the contact bar (better seen on FIGS. 28 and 29) on the serpentine central elongated channel for fitting each seat within each V-shaped recess 34 (not shown on FIGS. 26 to 29).

It should be understood that the present invention is not limited to the above-described or illustrated geometries of the contact bar central portions and capping board central elongated channel, but further includes any geometry enabling to have an adequate recess of the contact bar for fitting into the corresponding lateral channels and central elongated channel of the capping board.

In another optional aspect, the contact bar or contact bar segment may include a retention member for reducing or preventing lateral movement of the electrodes which could result in slippage of the electrode hanging bars from the bearing members of the contact bar or contact bar segment.

Figure 30:
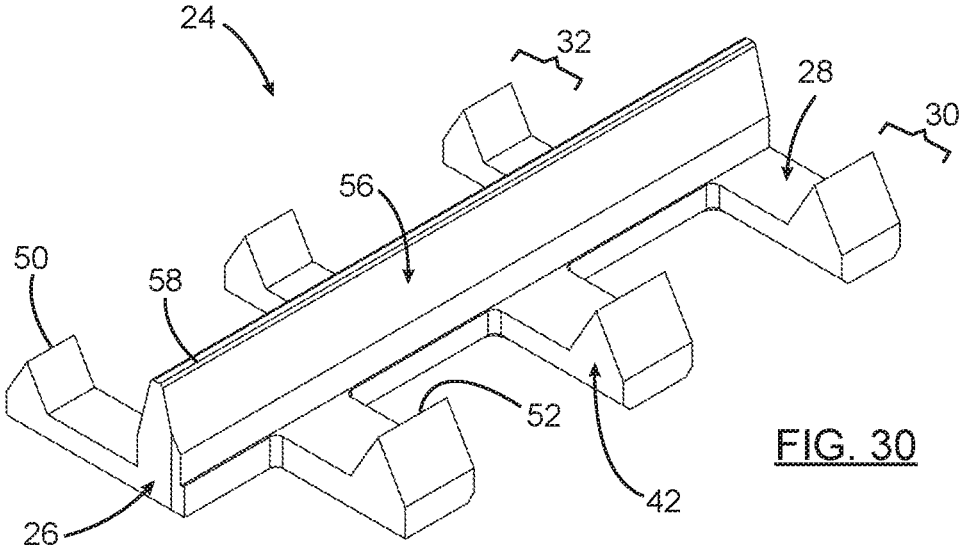
FIG. 30 is a top perspective view of a contact bar segment according to another embodiment of the present invention.

Referring to FIG. 30, the contact bar 22 (or contact bar segment 24) may include a retention member 56 having a body extending longitudinally along the central portion 26 and extending upwardly from the central portion 26 into a pointed distal end 58, so as to form a wall between the two rows 30/32 of branch portions 28. The distal end 58 of the retention member 56 may be higher than the ends 50/52 of the bearing members 42. The lateral movement of the electrode is therefore reduced or prevented by fitting one hanging bar of the electrode in a space between the retention member 56 and the bearing member 42. Part of the bottom of the hanging bar therefore rests on the bearing member 42 while the far end of the hanging bar abuts the retention member 56 or is slightly spaced-away from the retention member 56 such that it can abut against the retention member 56 if it moves toward it. Risks of slippage of hanging bars from the seats or the bearing members are therefore reduced or avoided.

Figure 31:
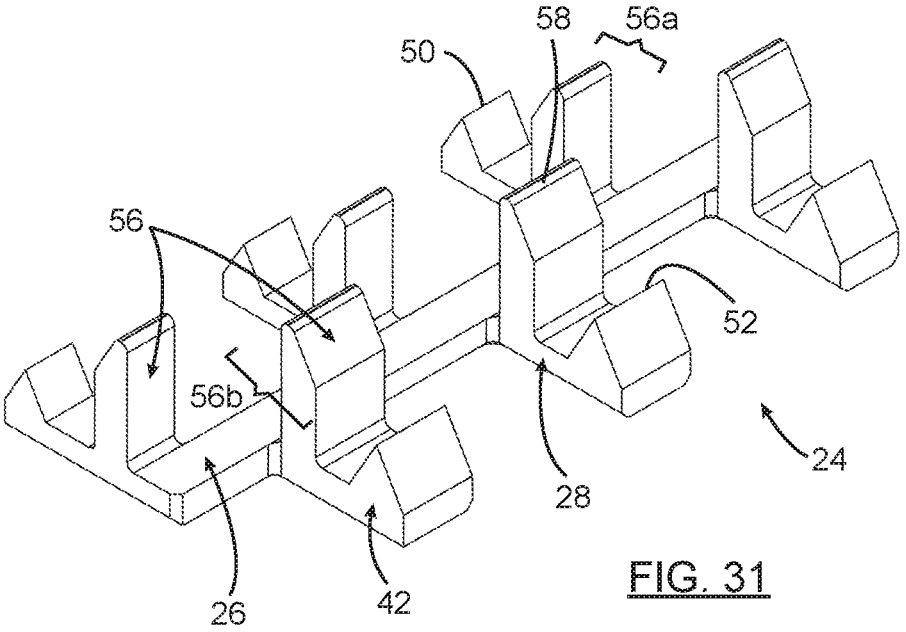
FIG. 31 is a top perspective view of a contact bar segment according to another embodiment of the present invention.

Referring to FIG. 31, the contact bar 22 (or contact bar segment 24) may also include a plurality of retention members 56, each retention member 56 being located on or with respect to a corresponding branch portion 28. The plurality of retention members 56 is organized in two sets of retention member rows arranged in a staggered relationship with one another; each retention member 56 being in spaced relationship with the corresponding bearing member 42 on the same branch portion 28, so as to help retain the electrode (not shown on the Figure) on the bearing member 42. Each retention member 56 may have an upper portion which is tapered toward the distal end 58. The upper portion may be tapered in such a manner to aid electrode placement, replacement and maintenance, for example by providing a sloping surface along which the hanging bar can slide or be guided until it rests on the bearing member 42. The retention member 56 may also have a central vertical surface facing the bearing member 42 and located to provide a vertical abutment or stop surface for the hanging bar which may have a corresponding vertical surface at its far end facing the abutment or stop surface of the retention member 56. The width of the retention member 56 may be the same as the one of the branch portion 28 on which it is located.

The hanging bars of the electrodes may be in contact with the retention member. The retention member(s) may be moulded with the contact bar or contact bar segment as a one-piece structure as seen on FIGS. 30 and 31; it may also be screwed, glued or nested into the contact bar.

Figure 32A:
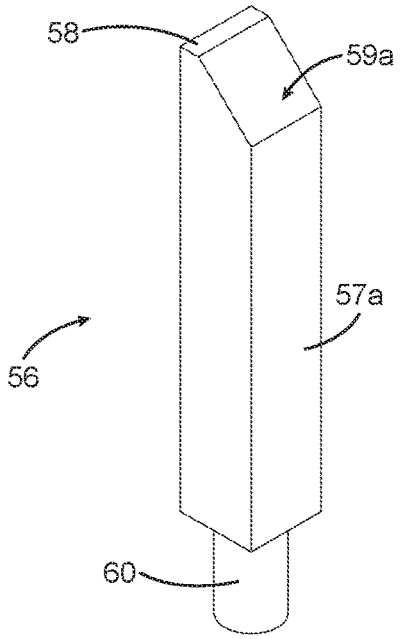
FIGS. 32 A and B are respective side perspective view and side view of a retention member according to another embodiment of the present invention.
Figure 32B:
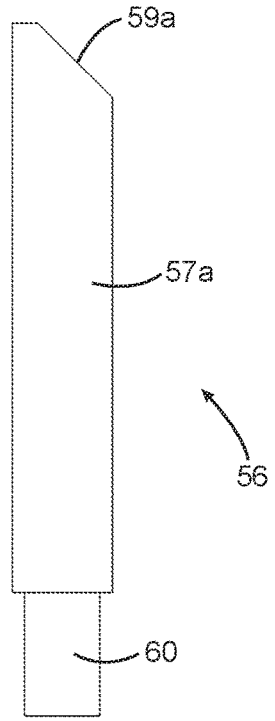
Figure 33A:
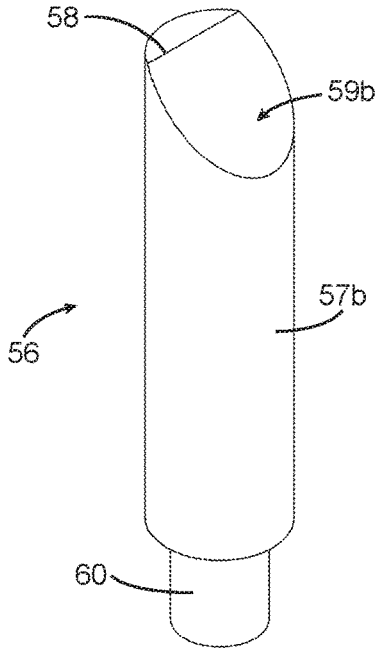
FIGS. 33 A and B are respective side perspective view and side view of a retention member according to another embodiment of the present invention.
Figure 33B:
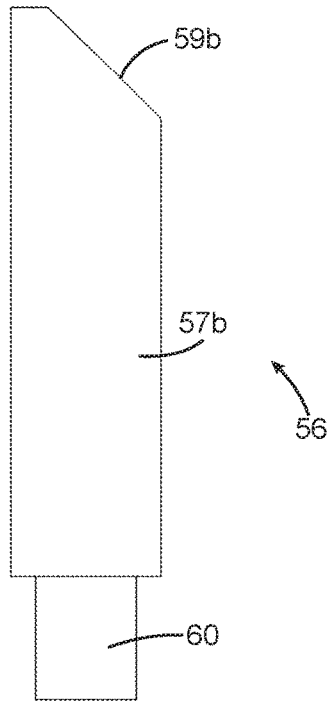

Referring to FIGS. 32 and 33, each retention member 56 may be an independent member configured and shaped to fit a corresponding location on the contact bar or contact bar segment. The retention member 56 may include a main rod 57*a* which has a square cross-section as shown in FIG. 32 or a main rod 57*b* which has a circular cross-section as shown in FIG. 33. Each retention member 56 may include an upper portion which is tapered toward the distal end 58, thereby forming a square tapered surface 59*a* (FIG. 32) or a circular tapered surface 59*b* (FIG. 33). Each retention member 56 further includes a proximal end being an attachment peg 60 which section is circular and smaller than the one of the main rod 57*a*/57*b*. The attachment peg 60 may be threaded so as to screw the retention member 56.

It should be understood that the shape and configuration of the attachment peg is not limited to what is shown on FIGS. 32 and 33, but includes any geometry enabling the retention member to be attached to the contact bar or contact bar segment. The retention member 56 may be made of electrically conducting or insulating material.

Figure 34:
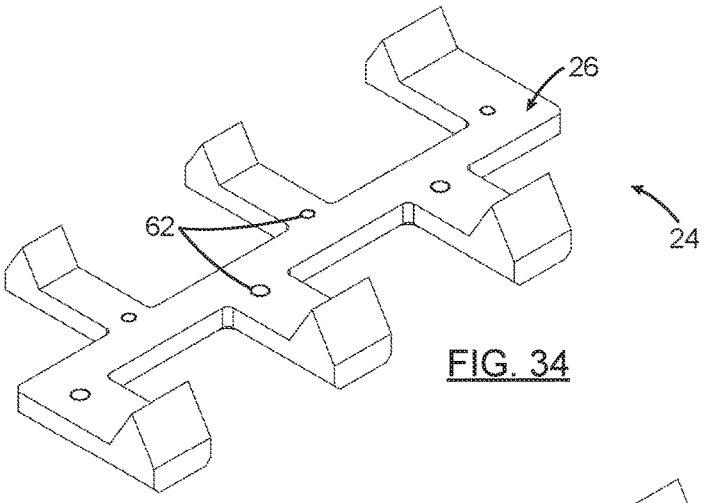
FIG. 34 is a top perspective view of a perforated contact bar segment according to another embodiment of the present invention.

Referring to FIG. 34, the contact bar 22 (or contact bar segment 24) may include a central portion 26 provided with two sets of holes 62 positioned so as to offer an attachment location at the proximal part of each branch portion 28. Each hole 62 may be threaded so as to screw the retention member (not shown on the FIG. 34) into the central portion 26. The holes 62 may be otherwise configured to cooperate with the attachment pegs (character 60 in FIGS. 32 and 33).

Figure 35:
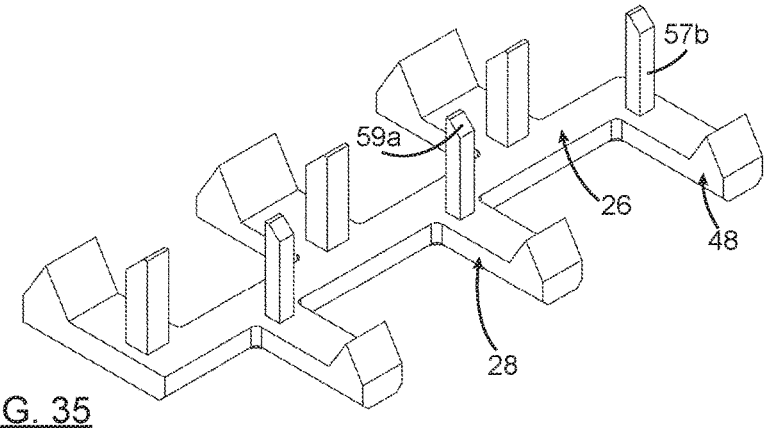
FIG. 35 is a top perspective view of a contact bar segment according to another embodiment of the present invention.
Figure 36:
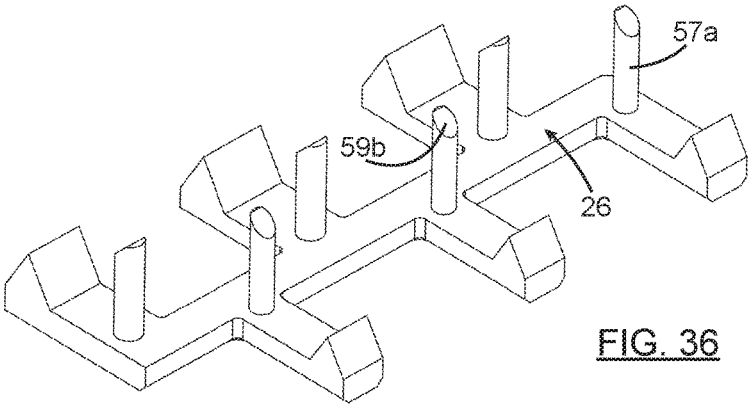
FIG. 36 is a top perspective view of a perforated contact bar segment according to another embodiment of the present invention.

Referring to FIGS. 35 and 36, the individual retention members may be attached to the central portion 26 of the contact bar 22 (or contact bar segment 24) so as to help keep the hanging bars of the electrodes (not shown on the Figures) on the bearing members 42 and prevent or reduce lateral movement which could result in slippage of the hanging bar, structural damage or functional problem. The main rods 57*a*/57*b* are arranged in two staggered sets of rows for associating each retention member 56 with the corresponding bearing member 48, each tapered surface 59*a*/59*b* facing each upper portion of the bearing members 48. The size of the retention member 56 may be proportional to the size of the corresponding bearing member 42.

The individual retention members may be screwed, glued or nested into the contact bar or may be formed integrally with the contact bar in a one-piece construction. In case of gluing, a chemical fixation may be provided by using a thermal glue, an epoxy glue, etc.

In another optional aspect, the capping board may include a holding arm which is sized and shaped to position and maintain the electrodes with respect to the contact bar. Indeed, movement of the electrodes could result in their undesired slippage from the bearing members of the contact bar.

Figure 37:
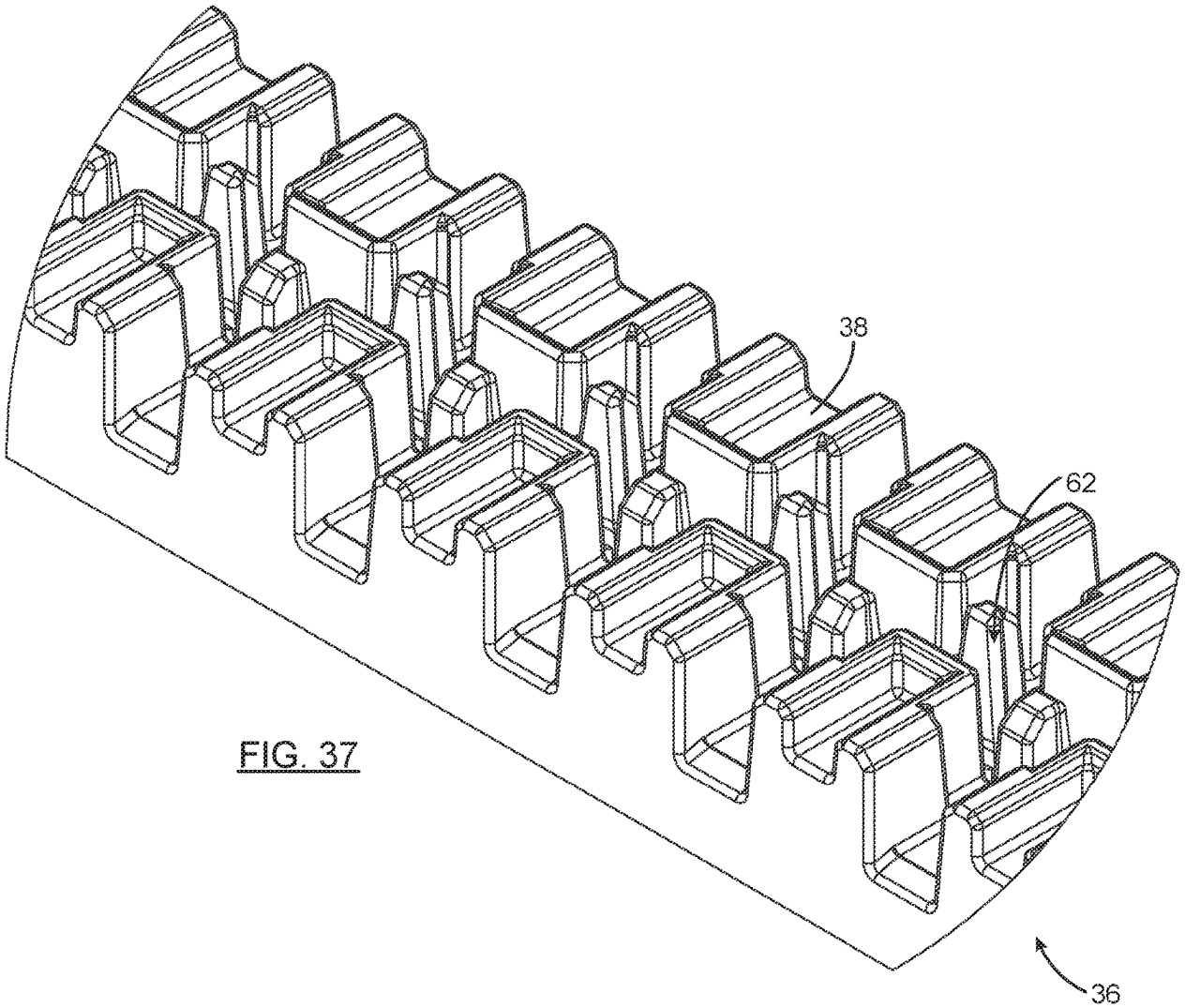
FIG. 37 is a top perspective view of a portion of a capping board according to another embodiment of the present invention.
Figure 38:
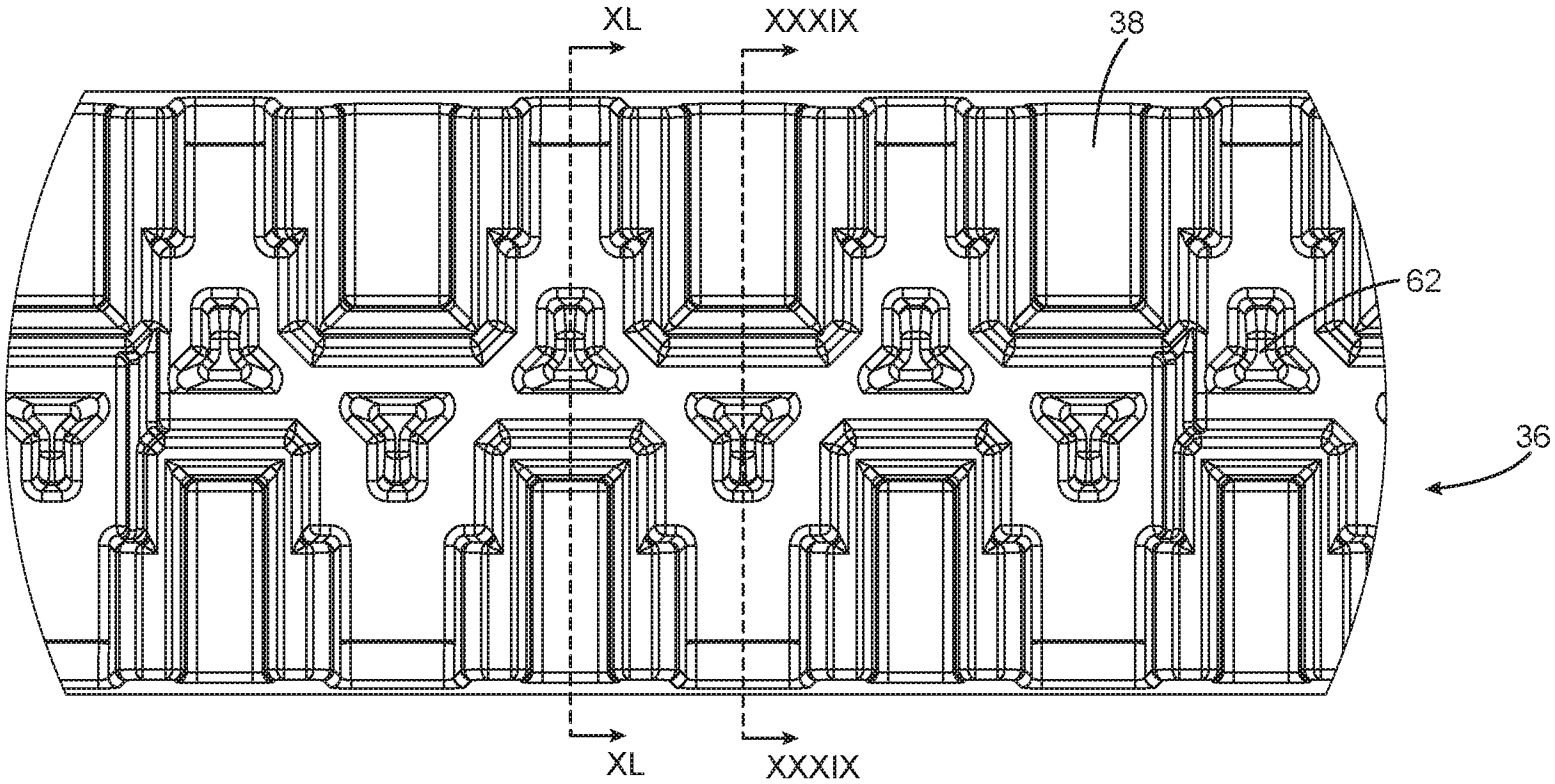
FIG. 38 is a top plan view of a portion of a capping board according to another embodiment of the present invention.

Referring to FIGS. 37 and 38, the capping board 36 includes a plurality of holding arms 62, each holding arm 62 projecting upwardly from the central elongated channel of the capping board 36. The holding arms 62 are located at the intersection of the central elongated channel and the lateral channels of the capping board 36. They are organized in two sets of rows arranged in a staggered relationship with one another along the central elongated channel of the capping board 36. Each holding arm 62 is in spaced relationship with the corresponding seat 38 on the same lateral channel of the capping board, so as to help retain the hanging bar of the electrode (not shown on the Figure).

Figure 41:
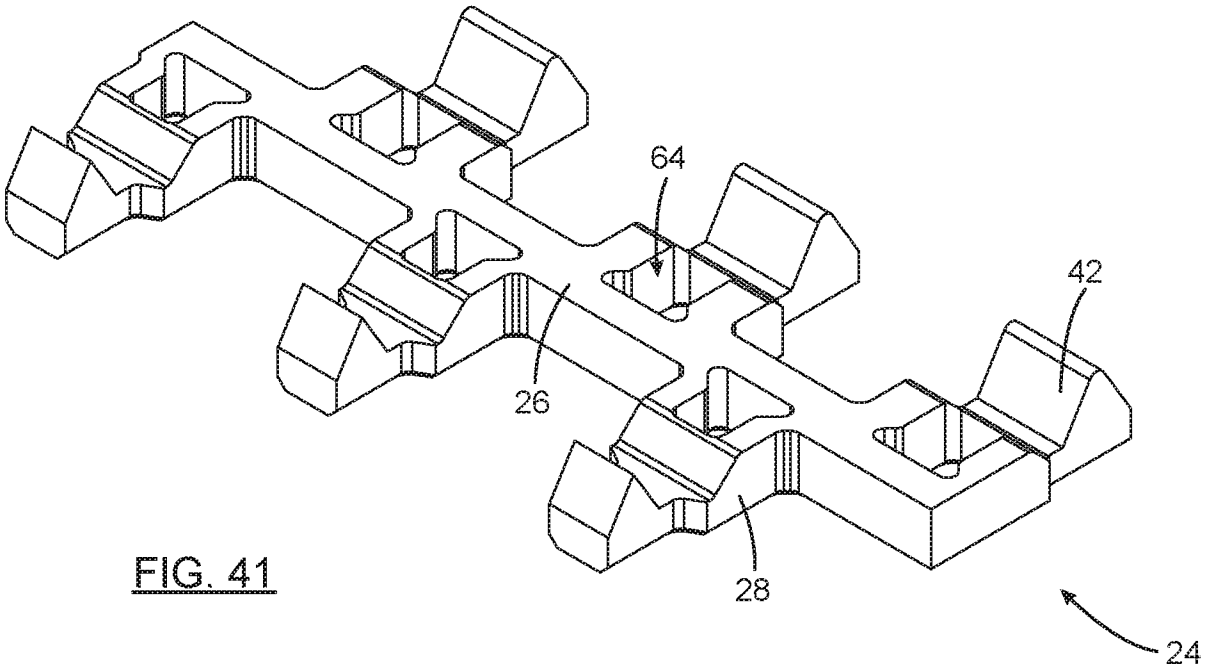
FIG. 41 is top perspective view of a contact bar segment according to another embodiment of the present invention.

Referring to FIG. 41, the contact bar 22 (or contact bar segment 24) includes apertures 64 sized and shaped so as to engage the holding arms of the capping board and maintain the electrodes in precise position while laying on the contact bar and abutting the corresponding holding arm. The apertures 64 are organized in two sets of rows arranged in a staggered relationship with one another along the central portion 26. Each aperture 64 is in spaced relationship with the corresponding bearing member 42 on the same branch portion 28, so as to receive the corresponding holding arms of the capping board.

Figure 45:
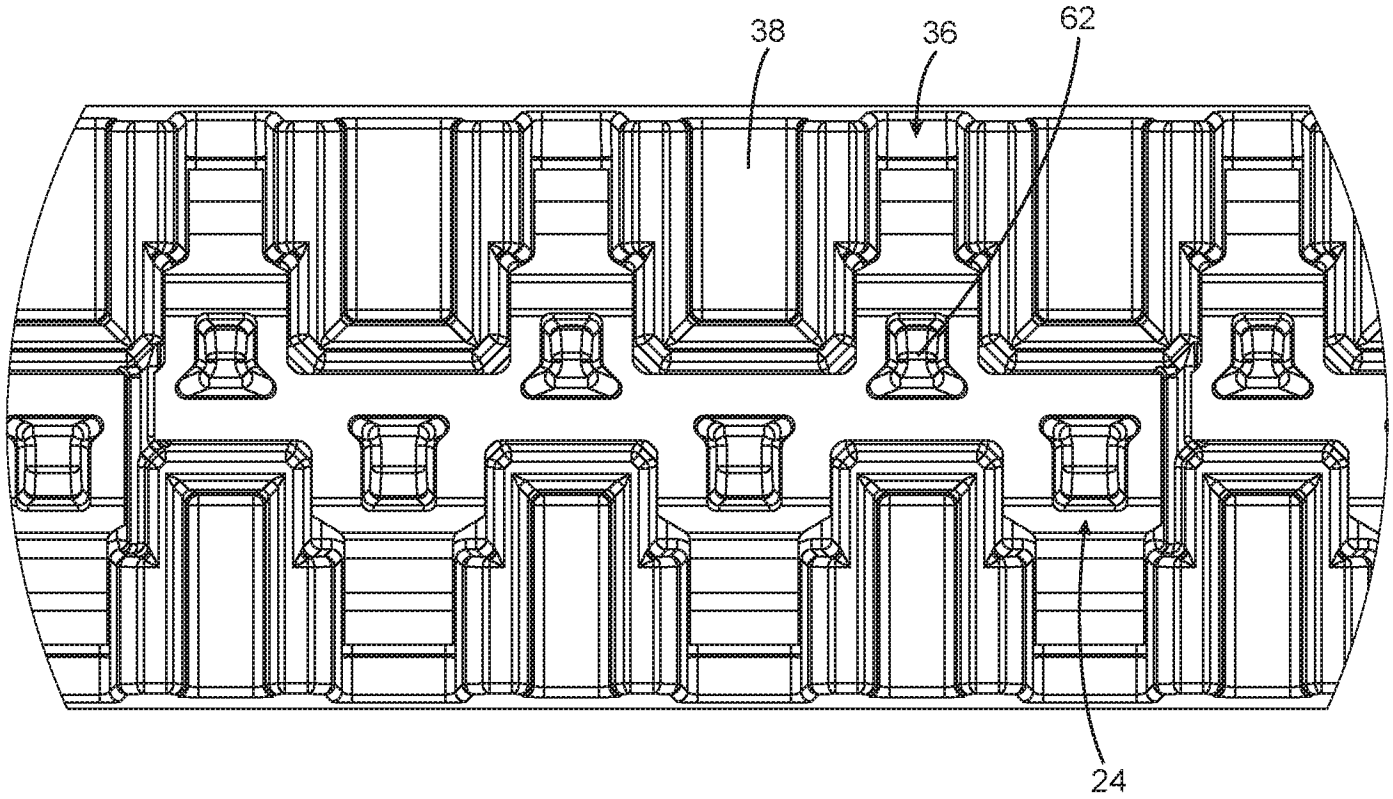
FIG. 45 is a top plan view of a portion of a capping board and contact bar assembly according to another embodiment of the present invention.
Figure 46:
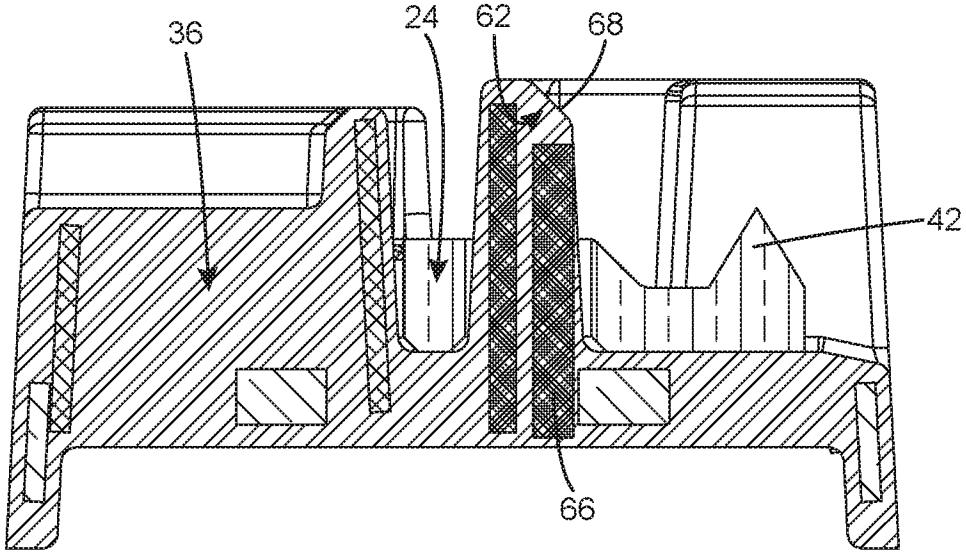
FIG. 46 is a side cross-sectional view along line XLVI of FIG. 45.
Figure 47:
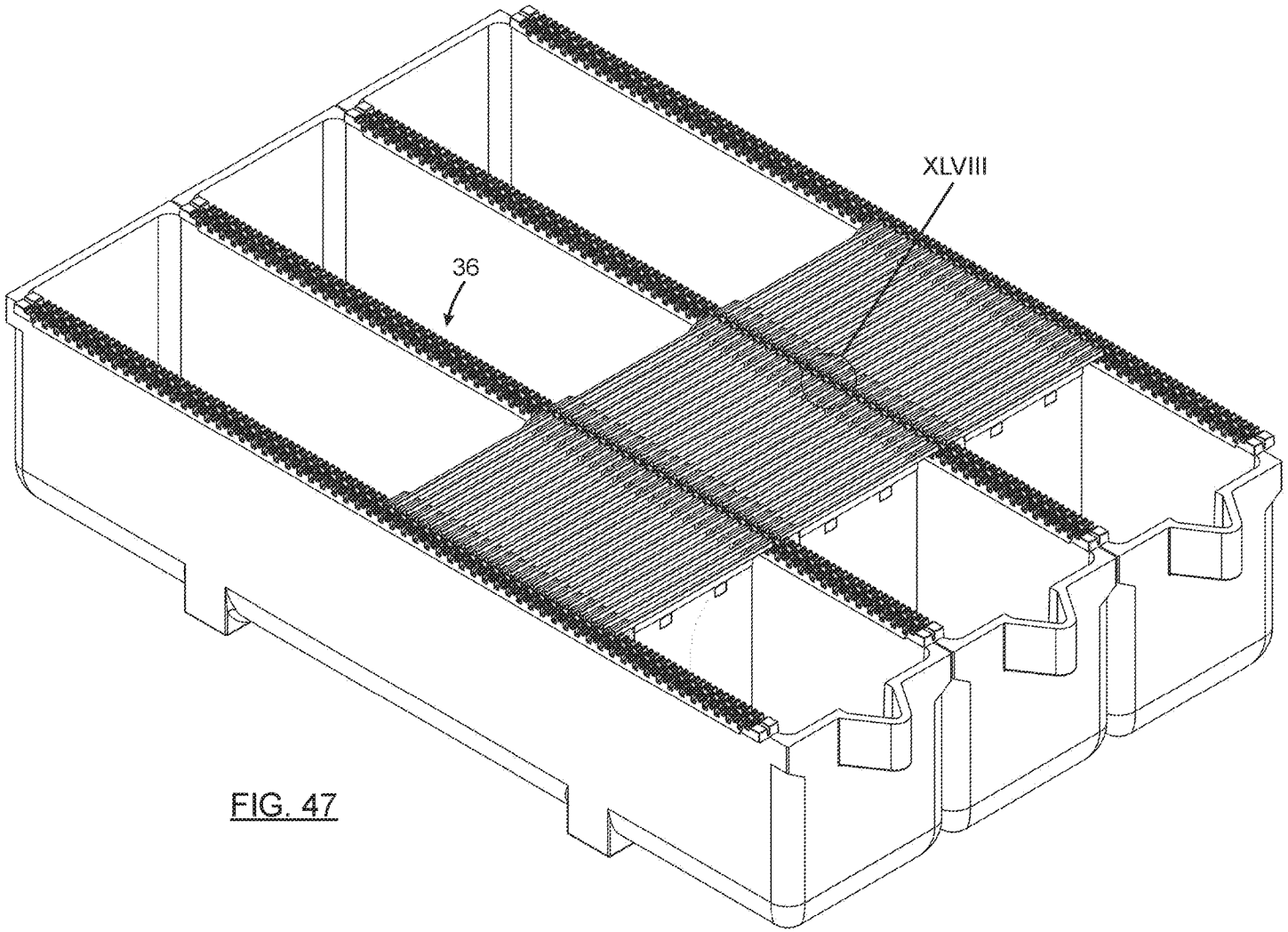
FIG. 47 is a top perspective view of an apparatus for electrolytic refining of metals including a capping board and contact bar assembly according to an embodiment of the present invention.
Figure 48:
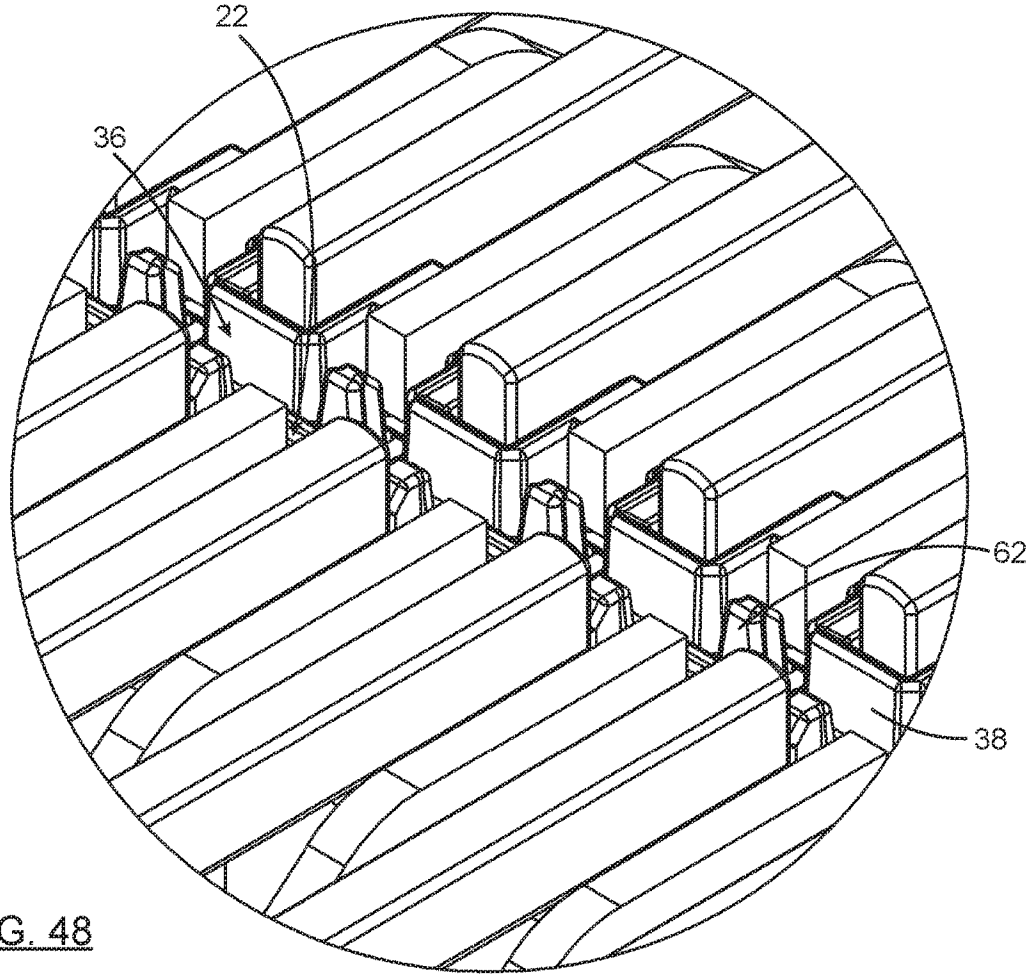
FIG. 48 is a close-up view of area XLVIII of FIG. 47.

FIG. 45 illustrates one contact bar segment 24 laying on the capping board 36 with the holding arms 62 inserted through the corresponding apertures 64 of the contact bar segment 24.

Holding arms help prevent or reduce movement of the electrodes relative to the capping board and help retain the hanging bar of the electrode resting on the contact bar.

Figure 39:
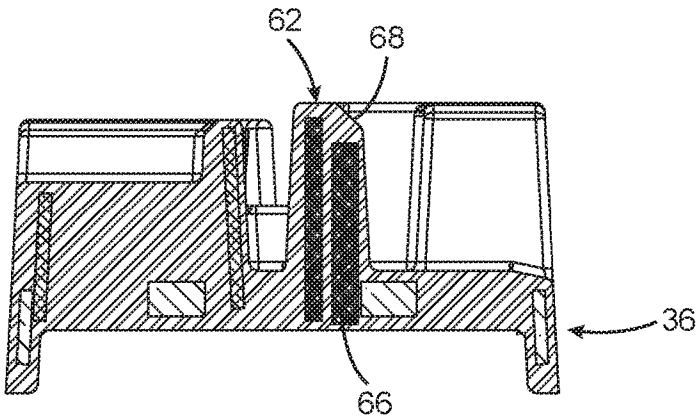
FIG. 39 is a side cross-sectional view along line XXXIX of FIG. 38.
Figure 40:
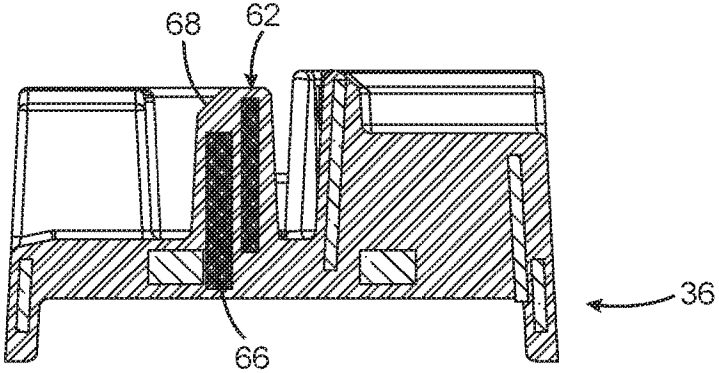
FIG. 40 is a side cross-sectional view along line XL of FIG. 38.

According to an optional aspect of the present invention, holding arms may include at least one reinforcing rod, providing enhanced rigidity and bending resistance to the holding arm. Referring to FIGS. 39 and 40, each holding arm 62 includes one or two reinforcing rods 66 sized and shaped to be embedded therein. Additionally, each holding arm 62 has an upper portion which is tapered toward a distal end of the arm 62, so as to form a tapered surface 68. As better seen in FIG. 46, the tapered surface 68 helps the hanging bar of the electrode (not shown in the Fig) slide onto the bearing member 42 of the contact bar 22 (or contact bar segment 24).

Figure 42:
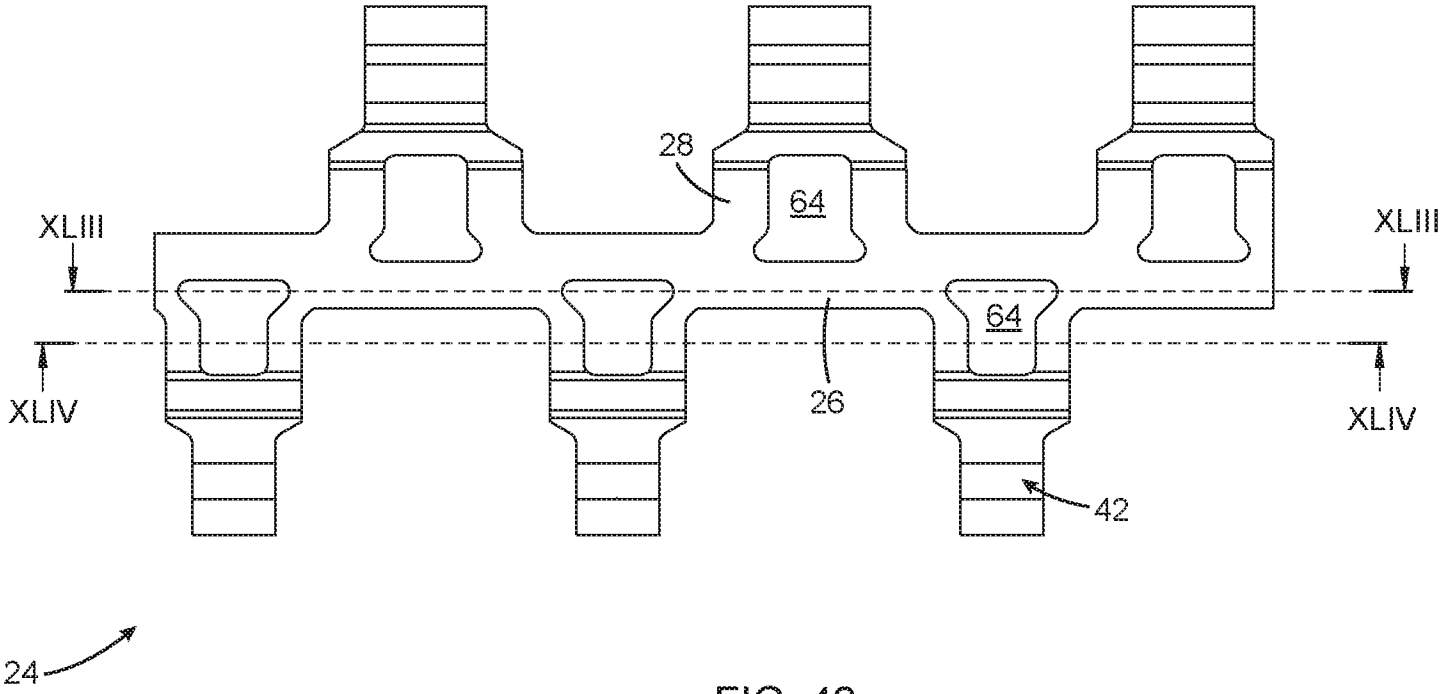
FIG. 42 is a top plan view of the contact bar segment of FIG. 41.
Figure 43:
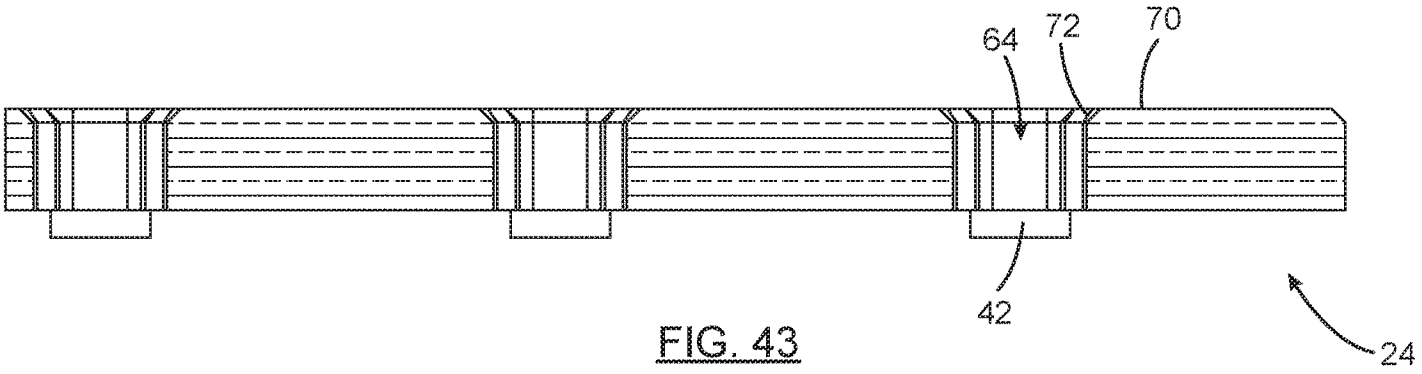
FIG. 43 is a side cross-sectional view along line XLIII of FIG. 42.
Figure 44:
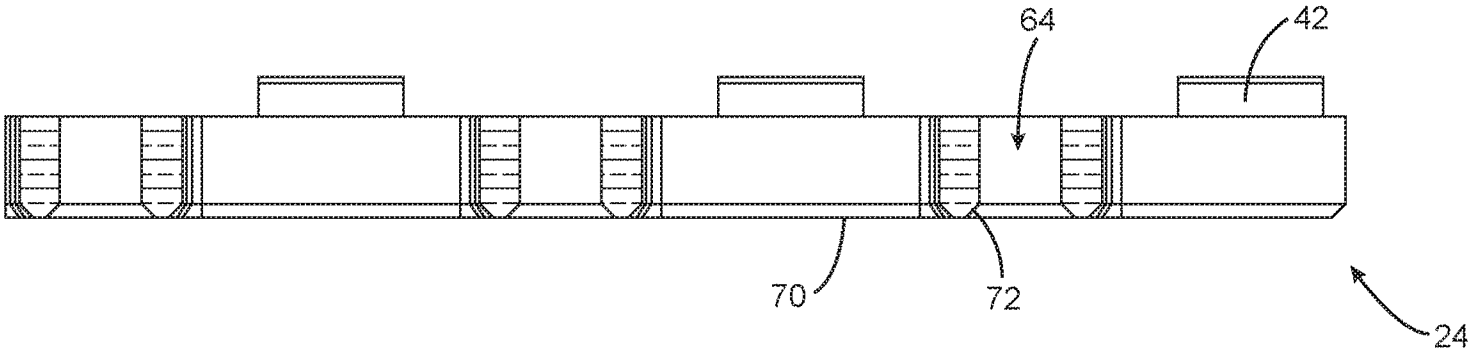
FIG. 44 is a side cross-sectional view along line XLIV of FIG. 42.

Referring to FIGS. 42 to 44, the apertures 64 may have an internal surface which includes a lower portion being tapered toward a bottom surface 70 of the contact bar 22 (or contact bar segment 24) so as to form another tapered surface 72. As the contact bar 22 (or contact bar segment 24) is inserted in the channels of the capping board, the tapered surface 72 helps the holding arm of the capping board sliding through the corresponding aperture 64. Preferably, the tapered surface of the aperture may be inclined at a 45° angle respectively to the bottom surface of the contact bar or contact bar segment.

It should be understood that the configuration and geometry of the holding arms and apertures may be adapted to contact bar (or contact bar segment) and capping board having respective V-shaped recesses and seats as previously described.

It should further be understood that shapes and sizes of the holding arms and corresponding apertures represented in FIGS. 37 to 46 is not limiting and may take various geometries as long as they provide retention of the hanging bars of the electrodes. For example, the apertures do not necessarily have to extend all the way through the contact bar, but could be recesses that receive the holding arms.

According to an optional aspect, the thickness (related to the volume of metallic material) of the contact bar may be proportional to the number of branch portions of the contact bar so as to avoid or reduce electrical losses at both extremities of the bar. A contact bar with many branch portions will need a greater thickness to ensure adequate distribution of the electricity to the electrodes located on bearing members at extremities of the contact bar.

The invention claimed is:

1. A capping board for use in an electrolytic cell with a contact bar or contact bar segment and symmetrical electrodes, the capping board comprising:

a main elongated body;

two rows of seats extending upward from the main elongated body, the seats providing support and electric insulation for the symmetrical electrodes, each of the two rows of seats being arranged in staggered or offset relationship with respect to the opposed row of seats so as to define a central elongated channel and adjacent seats of each row being spaced apart to define a lateral channel; and a plurality of holding arms organized in two sets of arm rows arranged in a staggered relationship with one another along the central elongated channel and in spaced relationship with the corresponding row of seats of the capping board, each holding arm projecting upwardly from the central elongated channel of the capping board;

wherein the central elongated channel and the lateral channel are sized and shaped for receiving the contact bar or the contact bar segment such that the latter provides support and electrical contact with hanging bars of the electrodes; and wherein each holding arm is sized and shaped to engage corresponding apertures of the contact bar or the contact bar segment such that the latter is securely held on the capping board, and each holding arm comprises at least one reinforcing rod sized and shaped to be embedded therein.

2. A capping board according to claim 1, wherein the central elongated channel is centered on the capping board.

3. A capping board according to claim 1, wherein each holding arm has an upper portion which is tapered toward a distal end of the holding arm, so as to form a tapered surface.

4. A contact bar and capping board assembly for use in an electrolytic cell with symmetrical electrodes, the assembly comprising:

a contact bar; and a capping board as defined in in claim 1.

5. A contact bar and capping board assembly for use in an electrolytic cell with symmetrical electrodes, the assembly comprising:

a contact bar; and a capping board as defined in in claim 2.

6. A contact bar and capping board assembly for use in an electrolytic cell with symmetrical electrodes, the assembly comprising:

a contact bar; and a capping board as defined in in claim 3.

7. A contact bar segment and capping board assembly for use in an electrolytic cell with symmetrical electrodes, the assembly comprising:

a plurality of contact bar segments, the contact bar segments being positioned adjacent to one another so as to form a contact bar; and a capping board as defined in claim 1.

8. A contact bar segment and capping board assembly for use in an electrolytic cell with symmetrical electrodes, the assembly comprising:

a plurality of contact bar segments, the contact bar segments being positioned adjacent to one another so as to form a contact bar; and a capping board as defined in claim 2.

9. A contact bar segment and capping board assembly for use in an electrolytic cell with symmetrical electrodes, the assembly comprising:

a plurality of contact bar segments, the contact bar segments being positioned adjacent to one another so as to form a contact bar; and a capping board as defined in claim 3.

10. A contact bar and capping board assembly for use in an electrolytic cell with symmetrical electrodes, the assembly comprising:

a capping board comprising:

a main elongated body, two rows of seats extending upward from the main elongated body, the seats providing support and electric insulation for the symmetrical electrodes, each of the two rows of seats being arranged in staggered or offset relationship with respect to the opposed row of seats so as to define a central elongated channel and adjacent seats of each row being spaced apart to define a lateral channel, and two rows of holding arms arranged in a staggered relationship with one another along the central elongated channel, each holding arm being in spaced relationship with the corresponding seat on the lateral channel; and a contact bar comprising:

a central portion laying on the central elongated channel of the capping board; and branch portions extending laterally outward from the central portion, the branch portions comprising two sets of branch portions configured on either side of the central portion and each set being in staggered or offset relationship to the opposed set, such that the branch portions fit in between seats of the capping board, each branch portion being spaced, sized and configured and having an electrode bearing member so as to provide support and electrical contact with hanging bars of one of the electrodes, and two rows of apertures arranged in opposed and staggered relationship with one another along the central portion, each aperture being in spaced relationship with the corresponding electrode bearing member on the branch portion, so as to receive the corresponding holding arms of the capping board.

11. A method of supporting and electrically contacting symmetrical electrodes in an electrolytic apparatus for refining metal, the method comprising:

providing a contact bar or contact bar segment as defined in claim 10;

providing a capping board as defined in claim 10; and placing symmetrical electrodes in electrical contact with corresponding electrode bearing members of the contact bar or contact bar segment.

* * * * *